US012203457B2

(12) United States Patent
Benson et al.

(10) Patent No.: US 12,203,457 B2
(45) Date of Patent: Jan. 21, 2025

(54) FUEL PUMP ASSEMBLY

(71) Applicant: CUMMINS-SCANIA HPCR SYSTEM, LLC, Columbus, IN (US)

(72) Inventors: Donald J. Benson, Columbus, IN (US); Eric A. Benham, Columbus, IN (US); Richard E. Duncan, Greenwood, IN (US)

(73) Assignee: Cummins-Scania HPCR System, LLC, Columbus, IN (US)

( * ) Notice: Subject to any disclaimer, the term of this patent is extended or adjusted under 35 U.S.C. 154(b) by 0 days.

(21) Appl. No.: 18/568,766

(22) PCT Filed: Jul. 11, 2022

(86) PCT No.: PCT/US2022/036695

§ 371 (c)(1),
(2) Date: Dec. 8, 2023

(87) PCT Pub. No.: WO2023/287709

PCT Pub. Date: Jan. 19, 2023

(65) Prior Publication Data

US 2024/0263624 A1 Aug. 8, 2024

Related U.S. Application Data

(60) Provisional application No. 63/221,660, filed on Jul. 14, 2021.

(51) Int. Cl.
*F04B 1/0417* (2020.01)
*F04B 53/00* (2006.01)

(52) U.S. Cl.
CPC ..... *F04B 1/0417* (2013.01); *F04B 53/006* (2013.01)

(58) Field of Classification Search
CPC ..... F04B 1/0417
See application file for complete search history.

(56) References Cited

U.S. PATENT DOCUMENTS 3,000,319 A 9/1961 Tuck
5,888,054 A 3/1999 Djordjevic
(Continued)

FOREIGN PATENT DOCUMENTS

CN 1605748 A 4/2005
CN 104395597 A 3/2015
(Continued)

OTHER PUBLICATIONS

International Search Report and Written Opinion for PCT Application No. PCT/US2022/036695, dated Oct. 27, 2022.

*Primary Examiner* — Vicky A Johnson
(74) *Attorney, Agent, or Firm* — Foley & Lardner LLP

(57) ABSTRACT

A fuel pump assembly includes a fuel pump. The fuel pump includes a camshaft having a cam lobe. The camshaft is configured to rotate. The fuel pump includes a first cam roller and a second cam roller disposed about an outer surface of the cam lobe, a first pumping assembly configured to interact with the first cam roller, and a second pumping assembly configured to interact with the second cam roller. The second pumping assembly is offset from the first pumping assembly. The fuel pump further includes a housing configured to support the camshaft, the first cam roller, the second cam roller, the first pumping assembly, and the second pumping assembly.

18 Claims, 6 Drawing Sheets

(56) References Cited

U.S. PATENT DOCUMENTS

| | | | | |
|---|---|---|---|---|
| 6,763,808 | B2 | 7/2004 | Ryuzaki | |
| 7,080,631 | B2 | 7/2006 | Hanyu | |
| 7,544,051 | B2 | 6/2009 | Bootle | |
| 2004/0213689 | A1 | 10/2004 | Mori | |
| 2005/0047929 | A1 | 3/2005 | Hanyu | |
| 2011/0052427 | A1* | 3/2011 | Shaull | F02M 59/102 417/364 |
| 2014/0366849 | A1 | 12/2014 | Felton | |
| 2017/0191384 | A1 | 7/2017 | Oka et al. | |
| 2019/0003435 | A1 | 1/2019 | Vukadinovic et al. | |

FOREIGN PATENT DOCUMENTS

| | | | | | |
|---|---|---|---|---|---|
| CN | 106150806 | A | | 11/2016 | |
| CN | 106968855 | A | * | 7/2017 | F02M 39/02 |
| DE | 10 2009 001 315 | A1 | | 9/2010 | |
| EP | 1 270 929 | A1 | | 1/2003 | |
| EP | 3 091 220 | A1 | | 11/2016 | |
| WO | WO-2008/066635 | A1 | | 6/2008 | |
| WO | WO-2018/077652 | A1 | | 5/2018 | |
| WO | WO-2021/183117 | A1 | | 9/2021 | |

* cited by examiner

FUEL PUMP ASSEMBLY

CROSS-REFERENCE TO RELATED PATENT APPLICATIONS

This application is the U.S. National Phase of PCT Application No. PCT/US2022/036695, filed Jul. 11, 2022, which claims priority to and the benefit of U.S. Provisional Patent Application No. 63/221,660, filed Jul. 14, 2021, the entire disclosure of which is incorporated herein by reference.

TECHNICAL FIELD

The present disclosure relates to a fuel pump assembly for use in high fuel pressure conditions.

BACKGROUND

Fuel pumps are provided on combustion engines to deliver high-pressure fuel to the fuel injectors, which thereby enables high-pressure injection events when the engine is operating. Depending on the operating parameters of the engine, fuel pumps may be configured to handle high and/or low fuel pressures. Where high pressure fuel is required, high-pressure, fuel-lubricated pumps may be used. However, even though such fuel pumps are designed for high-pressure fuels, the forces applied on the various components result in fatigue and wear of the components and power losses.

SUMMARY

In one set of embodiments, a fuel pump assembly for an engine includes a fuel pump. The fuel pump includes a camshaft having a cam lobe. The camshaft is configured to rotate. The fuel pump includes a first cam roller and a second cam roller disposed about an outer surface of the cam lobe, a first pumping assembly configured to interact with the first cam roller, and a second pumping assembly configured to interact with the second cam roller. The second pumping assembly is offset from the first pumping assembly.

In another set of embodiments, an engine system includes an engine block, a cylinder head coupled to the engine block, and a fuel system. The fuel system includes a plurality of fuel injectors positioned within the cylinder head and includes a fuel pump. The fuel pump includes a camshaft having a cam lobe. The camshaft is configured to rotate. The fuel pump includes a first cam roller and a second cam roller disposed about an outer surface of the cam lobe, a first pumping assembly configured to interact with the first cam roller, and a second pumping assembly configured to interact with the second cam roller. The second pumping assembly is offset from the first pumping assembly.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, where.

DETAILED DESCRIPTION

Figure 1:
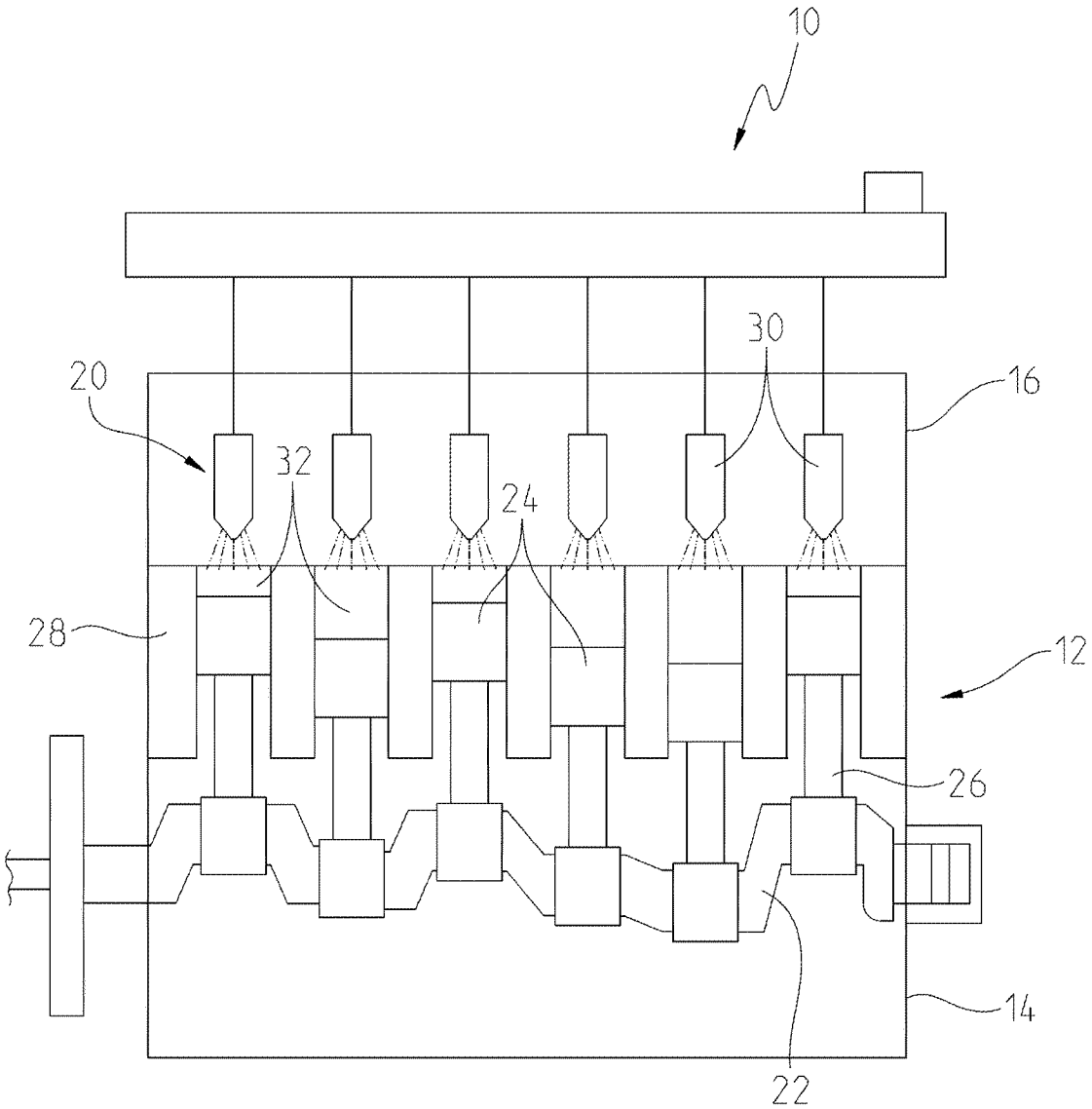
FIG. 1 is a schematic view of an internal combustion engine configured for use with a fuel pump assembly of an example embodiment.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, any alterations and further modifications in the illustrated embodiments, and any further applications of the principles of the disclosure as illustrated therein as would normally occur to one skilled in the art to which the disclosure relates are contemplated herein.

Referring to the Figures generally, the various embodiments disclosed herein relate to fuel-lubricated fuel pumps configured for various fuel pressures, including high fuel pressures. The configuration of the fuel pumps disclosed herein provide a plunger interface design which acts to improve the fatigue capability of the plunger at the plunger foot transition, reduce side loading forces at the plunger to decrease wear and scuffing power losses, and reduce the sliding motion of the plunger foot at the interface with the cam ring or roller.

The figures illustrate an eccentric pump with two plungers and two cam rings operating on a single cam lobe. The pump assembly has an eccentric cam of a camshaft. The eccentric cam rotates with the camshaft. There is a fluid film between the inner diameter of the cam ring and the outer diameter of the cam lobe such that the cam ring has a rotational degree of freedom relative to the cam. The two plungers reciprocate in accordance with the revolution of the cam ring to pressurize fuel which enters into and exits from the fuel pressurizing chambers which change in volume in response to the axial motion of the plungers. The two plungers, which out of phase with each other both share the same cam lobe, operate with separate cam rings. As a result of the design of the plunger and each plunger operating with its own cam ring, the dominant contact mechanism at the interface between the cam ring and the plunger foot is rolling and not sliding, which acts to improve the durability and performance of the pump, peak operating pressure capability, and packaging while minimizing cost. Additionally, having two separate cam rollers operating on the single lobe eliminates the need for two separate cam lobes which would otherwise separate the distance between the two cam rollers. This further reduces costs, needed space, and weight of the pump assembly.

Referring to FIG. 1, a portion of an internal combustion engine 10 is shown as a simplified schematic. The engine 10 includes an engine body 12, which supports an engine block 14, a cylinder head 16 coupled to the engine block 14, and a fuel system 20. The engine body 12 further includes a crankshaft 22, a plurality of pistons 24, and a plurality of connecting rods 26. The pistons 24 are configured for reciprocal movement within a plurality of engine cylinders 28, with one piston 24 positioned in each engine cylinder 28.

Each piston 24 is operably coupled to the crankshaft 22 through one of the connecting rods 26. A plurality of combustion chambers 32 are each defined by the combination of one piston 24, cylinder head 16, and engine cylinder 28. The movement of the pistons 24 under the action of a combustion process in the engine 10 causes the connecting rods 26 to move the crankshaft 22.

When the engine 10 is operating, a combustion process occurs in the combustion chambers 32 to cause movement of the pistons 24. The movement of the pistons 24 cause movement of the connecting rods 26, which are drivingly connected to the crankshaft 22, and movement of the connecting rods 26 causes rotary movement of the crankshaft 22. The angle of rotation of the crankshaft 22 may be measured by a control system to aid in timing the combustion events in the engine 10 and for other purposes. The angle of rotation of the crankshaft 22 may be measured in a plurality of locations, including a main crank pulley (not shown), an engine flywheel (not shown), an engine camshaft (not shown), or on crankshaft 22.

The fuel system 20 includes a plurality of fuel injectors 30 positioned within the cylinder head 16. Each fuel injector 30 is fluidly coupled to one combustion chamber 32. In operation, the fuel system 20 provides fuel to the fuel injectors 30, which is then injected into the combustion chambers 32 by the action of the fuel injectors 30. As detailed further herein, the injection cycle may be defined as the interval that begins with the movement of a nozzle or needle element of the fuel injector 30 to permit fuel to flow from the fuel injector 30 into an associated combustion chamber 32, and ends when the nozzle or needle element moves to a position to block the flow of fuel from the fuel injector 30 into the combustion chamber 32.

In various embodiments, the crankshaft 22 may be operatively coupled with a camshaft of at least one fuel pump via a drive mechanism (e.g., a gear train, a timing belt, a timing chain, etc.) (not shown). The crankshaft 22 thus may drive the at least one fuel pump to pull fuel from the fuel tank in order to move fuel toward the fuel injectors 30. In various embodiments, fuel system 20 includes an electric lift pump to pull fuel from the fuel tank and supply fuel to the at least one fuel pump. A control system (not shown) provides control signals to the fuel injectors 30 that determine operating parameters for each fuel injector 30, such as the length of time the fuel injectors 30 operate and the number of fueling pulses per a firing or injection cycle period, thereby determining the amount of fuel delivered by each fuel injector 30.

Figure 2:
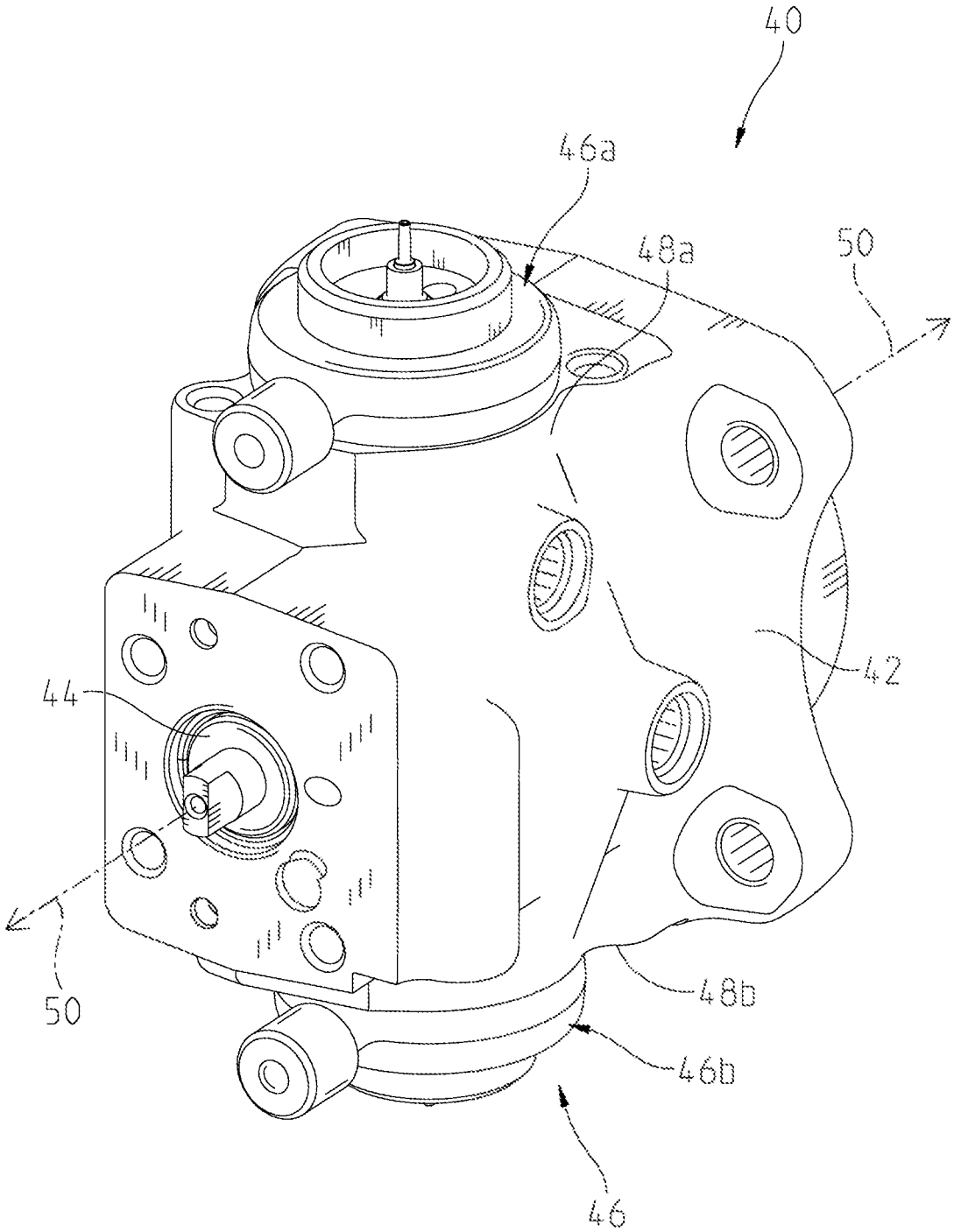
FIG. 2 is a perspective view of a fuel pump assembly of an example embodiment.

Referring to FIG. 2, a fuel pump 40 may be a high-pressure, fuel-lubricated pump. The fuel pump 40 includes a housing 42 configured to support a plurality of components, such as a drive member, illustratively a camshaft 44, configured to rotate about an axis of rotation 50 and at least one pumping assembly 46. The camshaft 44 may be coupled to a drive mechanism (e.g., a gear, gear train, etc.) (not shown). In various embodiments, the at least one pumping assembly 46 is a unit barrel pumping assembly. In various embodiments, the at least one pumping assembly 46 is integral to the housing 42. Illustratively, the pumping assembly 46 includes a first pumping assembly 46*a* positioned on a first side 48*a* of housing 42 and a second pumping assembly 46*b* positioned on a second, opposing side 48*b* of the housing 42. In various embodiments, the pumping assembly 46 may further include a third pumping assembly (not shown). The camshaft 44 is configured to extend through the housing 42. As shown, the camshaft 44 is supported within a central cavity 52 of the housing 42. The first pumping assembly 46*a* and the second pumping assembly 46*b* are positioned on opposing sides of the central cavity 52 in a direction perpendicular to the camshaft axis of rotation 50. For instance, in various embodiments the first pumping assembly 46*a* and the second pumping assembly 46*b* are positioned approximately 180 degrees from each other relative to the axis of rotation 50. In various embodiments, the first pumping assembly 46*a* and the second pumping assembly 46*b* may be positioned in other configurations as may be dictated by the space constraints of the fuel pump 40.

Referring now to FIGS. 3-6, the housing 42 further supports a first cam roller 54 (e.g., cam ring) configured to engage a cam lobe 56 of the camshaft 44. The first pumping assembly 46*a* includes a first plunger 70, a first tension member 68 (e.g., a spring), and a first valve assembly 72 configured to regulate the flow of low-pressure fluid into and out of a first pumping chamber 74. The first pumping chamber 74 is defined by a portion of the first plunger 70 and a portion of the first pumping assembly 46*a*, as disclosed further herein. The first plunger 70 also is fluidly coupled to a first plunger outlet valve 73 of the first pumping assembly 46*a*.

The first plunger 70 includes a first plunger foot 76. The first plunger foot 76 is configured to contact and ride along (e.g., is in confronting relation with) the first cam roller 54 during operation of the fuel pump 40. More particularly, during operation of the fuel pump 40, the camshaft 44 rotates, which thereby rotates the cam lobe 56. The camshaft 44 is an eccentric camshaft in that the center of rotation of the cam lobe 56 is offset relative to the axis of rotation 50 of the camshaft 44. The first cam roller 54 surrounds the cam lobe 56 and is configured to rotate about the cam lobe 56. A bushing 58 operating with a hydraulic film or fluid is positioned at the interface between the inner diameter of the first cam roller 54 and the outer diameter of the cam lobe 56 to facilitate the movement of the first cam roller 54 relative to the cam lobe 56. The first plunger 70 is biased towards the first cam roller 54 because of the first tension member 68 such that the first plunger foot 76 maintains contact with the first cam roller 54 during rotation thereof. The contact of the first plunger foot 76 with the first cam roller 54 results in reciprocation of the first plunger 70 along the walls because the rotation of the cam lobe 56 moves the first plunger 70 along a first reciprocation axis 82. The first reciprocation axis 82 is concentric with a center line of the first plunger 70.

As the first plunger 70 reciprocates along the first reciprocation axis 82 (resulting in movement of the first plunger 70), the first plunger foot 76 moves towards and away from axis of rotation 50 of camshaft 44, thereby adjusting the volume of the first pumping chamber 74. More particularly, when the cam lobe 56 rotates to a position towards the first pumping assembly 46*a*, the first plunger 70 also moves towards the first pumping assembly 46*a* and is in a top-dead-center position, thereby minimizing the volume of the first pumping chamber 74.

As the camshaft 44 continues to rotate about the axis of rotation 50 and the cam lobe 56 rotates towards the second pumping assembly 46*b*, the first plunger 70 reciprocates along the first reciprocation axis 82 and moves towards the axis of rotation 50. Because of the first tension member 68, the first plunger 70 is biased towards the first cam roller 54 and the first plunger 70 moves towards axis of rotation 50, thereby increasing the volume of the first pumping chamber 74. When the volume of the first pumping chamber 74 is maximized, the first plunger 70 is at a bottom-dead-center position and a maximum amount of fluid from the first pumping assembly 46*a* flows therein.

Figure 3:
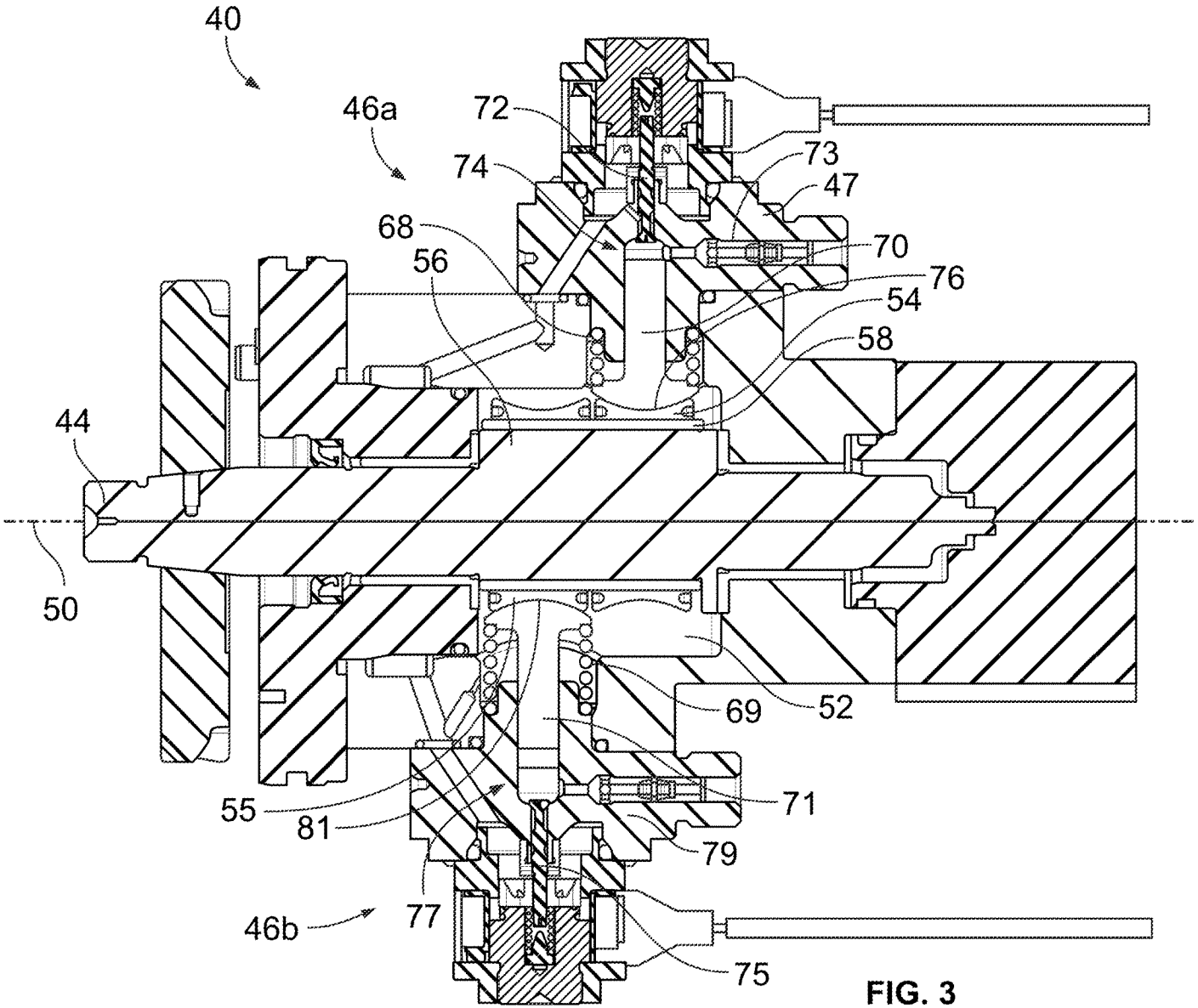
FIG. 3 is a schematic view of a fuel pump assembly of an example embodiment.
Figure 4:
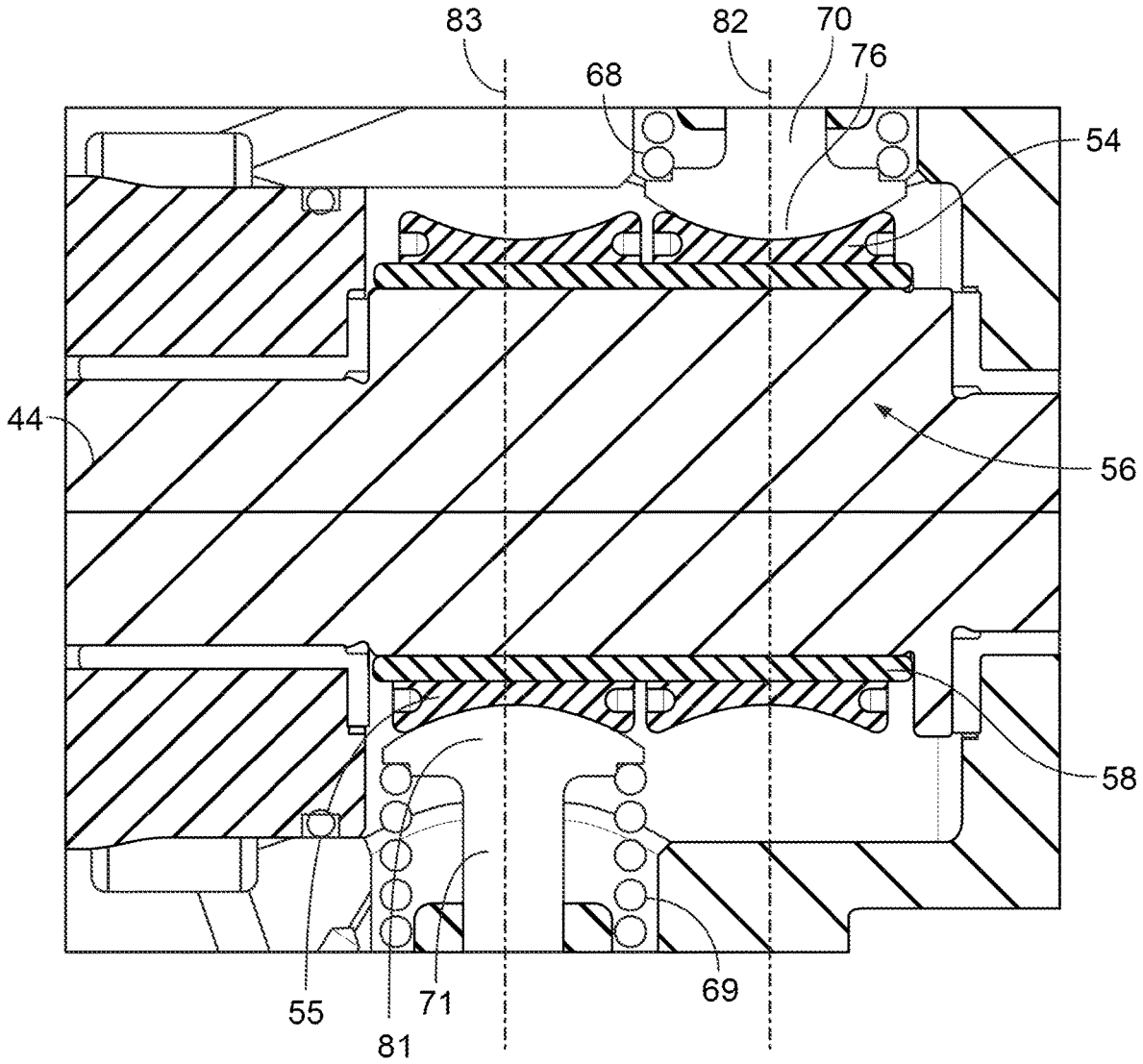
FIG. 4 is a further schematic view of the fuel pump assembly of FIG. 3.
Figure 5:
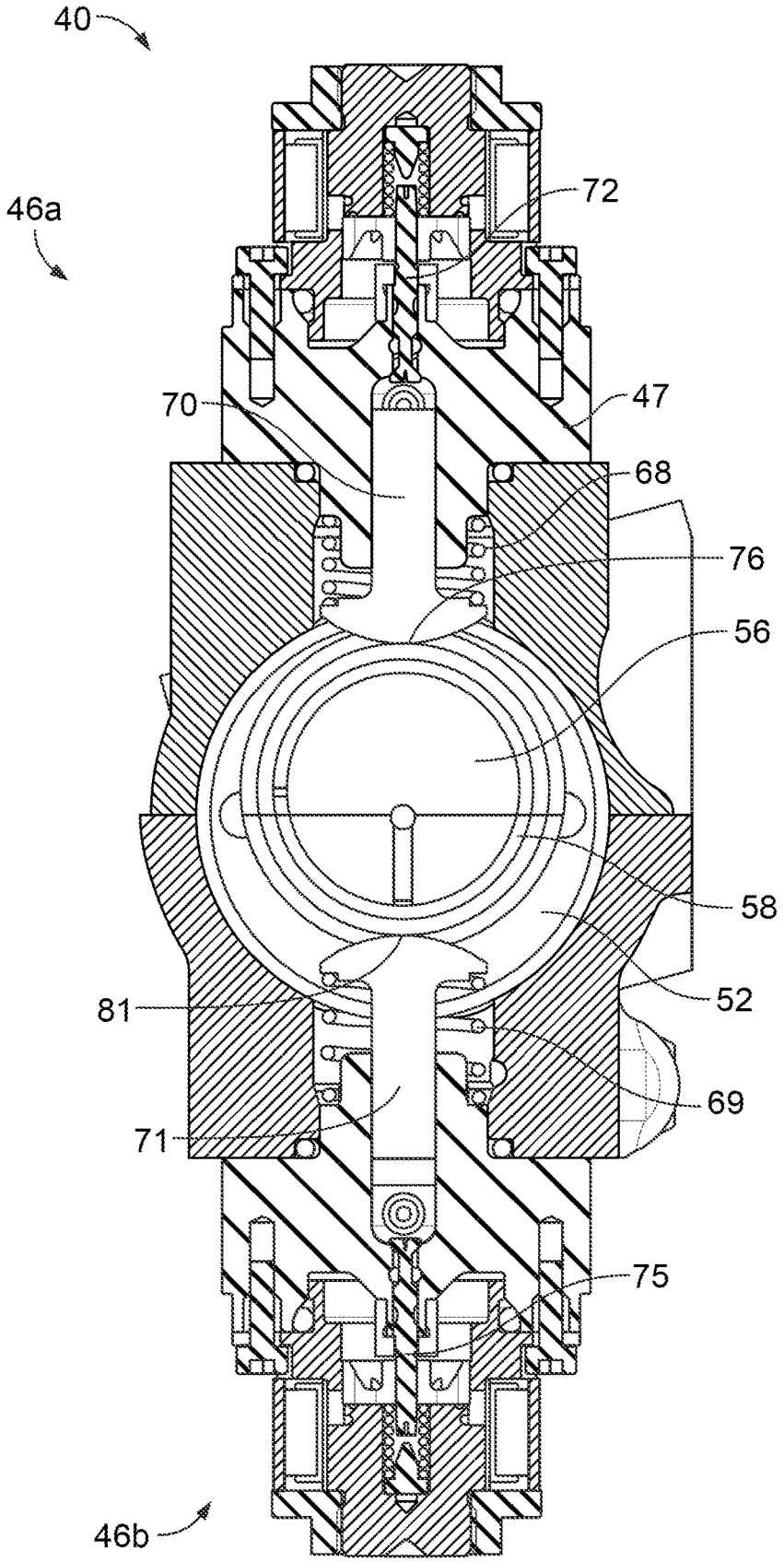
FIG. 5 is a front view of the fuel pump assembly of FIG. 3.

Referring still to FIGS. 3-4, the housing 42 further supports a second cam roller 55 (e.g., cam ring) configured to engage the cam lobe 56 of the camshaft 44. In various embodiments, the housing 42 may further support a third cam roller (not shown), and the third pumping assembly is configured to interact with the third cam roller. The second pumping assembly 46*b* includes a second plunger 71, a second tension member 69 (e.g., a spring), and a second valve assembly 75 configured to regulate the flow of low-pressure fluid into and out of a second pumping chamber 77. The second pumping chamber 77 is defined by a portion of the second plunger 71 and a portion of the second pumping assembly 46*b*. The second plunger 71 also is fluidly coupled to a second plunger outlet valve 79 of the second pumping assembly 46*b*.

The second plunger 71 includes a second plunger foot 81. The second plunger foot 81 is configured to contact and ride along (e.g., is in confronting relation with) the second cam roller 55 during operation of the fuel pump 40. More particularly, during operation of the fuel pump 40, the camshaft 44 rotates, which thereby rotates the cam lobe 56. The camshaft 44 is an eccentric camshaft in that the center of rotation of the cam lobe 56 is offset relative to the axis of rotation 50 of the camshaft 44. The second cam roller 55 surrounds the cam lobe 56 and is configured to rotate about the cam lobe 56. The bushing 58 operating with a hydraulic film or fluid is positioned at the interface between the inner diameter of the second cam roller 55 and the outer diameter of the cam lobe 56 to facilitate the movement of the second cam roller 55 relative to the cam lobe 56. The second plunger 71 is biased towards the second cam roller 55 because of the second tension member 69 such that the second plunger foot 81 maintains contact with the second cam roller 55 during rotation thereof. The contact of the second plunger foot 81 with the second cam roller 55 results in reciprocation of the second plunger 71 along the walls because the rotation of the cam lobe 56 moves the second plunger 71 along a second reciprocation axis 83. The second reciprocation axis 83 is concentric with a center line of the second plunger 71.

As the second plunger 71 reciprocates along the second reciprocation axis 83 (resulting in movement of the second plunger 71), the second plunger foot 81 moves towards and away from axis of rotation 50 of camshaft 44, thereby adjusting the volume of the second pumping chamber 77. More particularly, when the cam lobe 56 rotates to a position towards the second pumping assembly 46*b*, the second plunger 71 also moves towards the second pumping assembly 46*b* and is in a top-dead-center position, thereby minimizing the volume of the second pumping chamber 77.

As the camshaft 44 continues to rotate about the axis of rotation 50 and the cam lobe 56 rotates towards the first pumping assembly 46*a*, the second plunger 71 reciprocates along the second reciprocation axis 83 and moves towards the axis of rotation 50. Because of the second tension member 69, the second plunger 71 is biased towards the second cam roller 55 and the second plunger 71 moves towards the axis of rotation 50, thereby increasing the volume of the second pumping chamber 77. When the volume of the second pumping chamber 77 is maximized, the second plunger 71 is at a bottom-dead-center position and a maximum amount of fluid from the second pumping assembly 46*b* flows therein.

The first plunger foot 76 and the second plunger foot 81 may have varying configurations. For example, in the embodiment shown in FIGS. 3 and 4, each of the first plunger foot 76 and the second plunger foot 81 has a generally convex configuration. More particularly, a contact surface of each of the first cam roller 54 and the second cam roller 55 has a generally concave configuration corresponding with the convex geometric configuration of the at least one of the first plunger foot 76 and the second plunger foot 81, respectively. In various configurations, at least one of the first plunger foot 76 and the second plunger foot 81 may be concave whereas the contact surface of at least one of the first cam roller 54 and the second cam roller 55 is convex, corresponding with the concave geometric configuration of the at least one of the first plunger foot 76 and the second plunger foot 81, respectively. Due to the curved geometric configurations of the first plunger foot 76 and the first cam roller 54, the load distribution at the first cam roller 54 and the first plunger foot 76 is increased. By increasing the load distribution at the contact surface, bending stresses on the first plunger foot 76 are reduced.

Additionally, the first cam roller 54 and the first plunger foot 76, and the second cam roller 55 and the second plunger foot 81, may have other varying configurations. For example, the first cam roller 54, the first plunger foot 76, the second cam roller 55, and the second plunger foot 81 may have generally flat or linear configurations. The first flat geometric configuration of at least one of the first plunger foot 76 and the second plunger foot 81 corresponds with the second flat geometric configuration of at least one of the first cam roller 54 and the second cam roller 55, respectively. For example, the first cam roller 54, the first plunger foot 76, the second cam roller 55, and the second plunger foot 81 may have generally flat or linear configurations near the center of contact regions between the first plunger foot 76 and the first cam roller 54 and between the second plunger foot 81 and the second cam roller 55, and then have surfaces near the outer limits of the contact regions in which the local axial separation distances between the surfaces of the first plunger foot 76 and the first cam roller 54, and between the surfaces of the second plunger foot 81 and the second cam roller 55, are increased to reduce edge loading magnitudes between the contacting surfaces.

Figure 6:
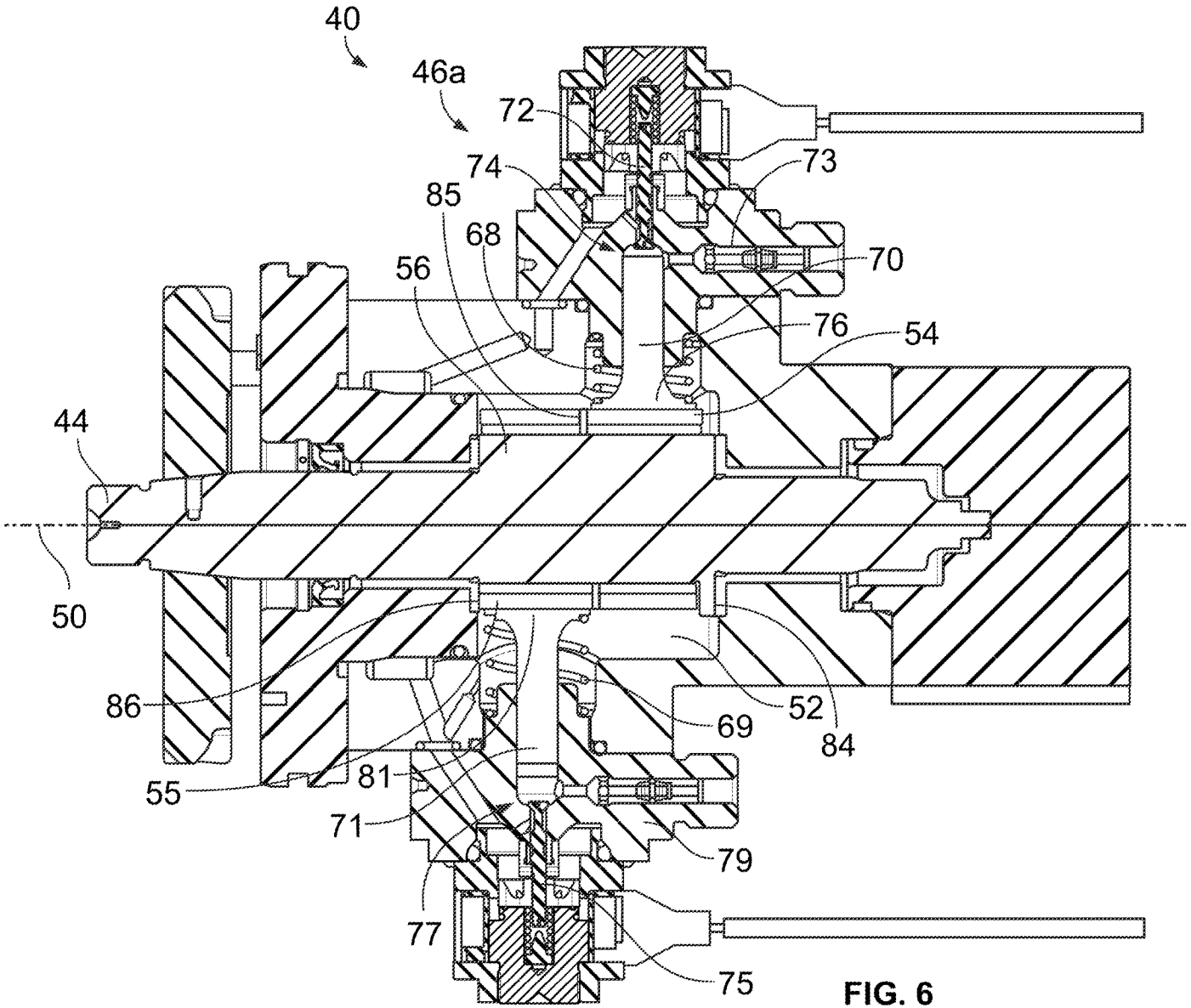
FIG. 6 is a schematic view of a fuel pump assembly of an example embodiment.

Referring now to FIG. 6, in various embodiments, the fuel pump 40 may further include a first controlling mechanism 84 and a second controlling mechanism 85 configured to control the relative location of the first cam roller 54 with respect to the first plunger 70 (e.g., the first reciprocation axis 82). For instance, the first cam roller 54 and the first plunger foot 76 may be configured to cooperate with a first controlling mechanism 84 and a second controlling mechanism 85 disposed on the cam lobe 56. In various embodiments, the first controlling mechanism 84 and a second controlling mechanism 85 may be disposed on the housing 42. More particularly, the first controlling mechanism 84 and a second controlling mechanism 85 may control the first cam roller 54 with respect to the first plunger 70, and if necessary, carry the thrust load. The second cam roller 55 and the second plunger foot 81 may be configured to cooperate with the second controlling mechanism 85 and a third controlling mechanism 86 disposed on the cam lobe 56. In various embodiments, the second controlling mechanism 85 and a third controlling mechanism 86 may be disposed on the housing 42. More particularly, the second controlling mechanism 85 and a third controlling mechanism 86 may control a relative location of the second cam roller 55 with respect to the second plunger 71 and, if necessary, carry the thrust load.

During typical operation of the fuel pump 40, there is a first rolling motion between the first plunger foot 76 and the first cam roller 54, and a second rolling motion (independent of the first rolling motion) between the second plunger foot 81 and the second cam roller 55 since the first plunger 70 and the second plunger 71 operate in conjunction with their unique cam ring (i.e., the first cam roller 54 and the second cam roller 55, respectively).

In contrast, if the first plunger 70 and the second plunger 71 share the same cam ring/roller, the first plunger 70 and the second plunger 71 transmit forces which act on the cam ring in opposing rotational directions. The opposing force directions result in a sliding motion for at least one of the first plunger 70 and the second plunger 71 (e.g., between the plunger feet and its respective cam roller due to an imbalance in force applied through a full rotation of the cam lobe) at all times. This sliding generates heat, decreases efficiency, causes wear, etc. Thus, operating the first plunger 70 and the second plunger 71 each on its own unique cam ring (i.e., the first cam roller 54 and the second cam roller 55, respectively), results in the relative interface motion being predominately rolling. A relative offset in the location along the axis of rotation 50 between the plungers and their corresponding elements enables the first plunger 70 and the second plunger 71 to independently control the axial location of each of the first cam roller 54 and the second cam roller 55, respectively. By further rotationally offsetting the first plunger 70 and the second plunger 71, the two pumping events are sufficiently out of phase of each other to both minimize the maximum positive and negative torques on the camshaft 44.

As shown and explained herein, the fuel pump 40 includes two pumping members, the first pumping assembly 46*a* and the second pumping assembly 46*b*, each comprising the first plunger 70 and the second plunger 71 and the first cam roller 54 and the second cam roller 55, respectively. As such, the first cam roller 54 rotates or revolves about the outer surface of the cam lobe 56 and the reciprocating motion of the first plunger 70 allows the contact surface at the interface of the first plunger foot 76 and the first cam roller 54 to rotate without the opposing force of the second plunger 71 as the second cam roller 55 simultaneously rotates or revolves about the outer surface of the cam lobe 56, and vice versa. Positioning the first cam roller 54 and the second cam roller 55 on the same cam lobe 56 beneficially reduces the bending stresses on the camshaft 44 since the first cam roller 54 and the second cam roller 55 are in close proximately to each other. Further, by reducing the sliding effect between the plunger feet and the cam rollers, a reduction in friction and heat is observed which results in improved efficiency and a longer-life of the system.

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A fuel pump assembly for an engine, comprising:

a fuel pump comprising:

a camshaft having a cam lobe, the camshaft configured to rotate;

a first cam roller and a second cam roller disposed about an outer surface of the cam lobe, wherein the first cam roller and the second cam roller operate on the same cam lobe;

a first pumping assembly configured to interact with the first cam roller; and a second pumping assembly configured to interact with the second cam roller, wherein the second pumping assembly is offset from the first pumping assembly.

2. The fuel pump assembly of claim 1, further comprising a crankshaft configured to drive the fuel pump to pull fuel from a fuel tank to move the fuel toward a fuel injector, the crankshaft operatively coupled to the camshaft via a drive mechanism.

3. The fuel pump assembly of claim 1, wherein the first pumping assembly includes a first plunger and a first plunger foot, the first plunger foot in confronting relation with the first cam roller such that the first plunger is configured to reciprocate in response to rotation of the cam lobe with the camshaft.

4. The fuel pump assembly of claim 3, wherein the second pumping assembly includes a second plunger and a second plunger foot, the second plunger foot in confronting relation with the second cam roller such that the second plunger is configured to reciprocate in response to the rotation of the cam lobe with the camshaft, independently of reciprocal movement of the first plunger.

5. The fuel pump assembly of claim 4, wherein the fuel pump further includes a first controlling mechanism and a second controlling mechanism configured to control a relative location of the first cam roller with respect to the first plunger.

6. The fuel pump assembly of claim 5, wherein the fuel pump further includes a third controlling mechanism configured to control, with the second controlling mechanism, a relative location of the second cam roller with respect to the second plunger.

7. The fuel pump assembly of claim 4, further comprising at least one of a first tension member configured to bias the first plunger towards the first cam roller and a second tension member configured to bias the second plunger towards the second cam roller.

8. The fuel pump assembly of claim 4, wherein:

at least one of the first plunger foot and the second plunger foot is configured with a convex geometric configuration; and at least one of the first cam roller and the second cam roller is configured with a concave geometric configuration, corresponding with the convex geometric configuration of the at least one of the first plunger foot and the second plunger foot, respectively.

9. The fuel pump assembly of claim 4, wherein:

at least one of the first plunger foot and the second plunger foot is configured with a concave geometric configuration; and at least one of the first cam roller and the second cam roller is configured with a convex geometric configuration, corresponding with the concave geometric configuration of the at least one of the first plunger foot and the second plunger foot, respectively.

10. The fuel pump assembly of claim 4, wherein:

at least one of the first plunger foot and the second plunger foot is configured with a first flat geometric configuration; and at least one of the first cam roller and the second cam roller is configured with a second flat geometric configuration, corresponding with the first flat geometric configuration of the at least one of the first plunger foot and the second plunger foot, respectively.

11. The fuel pump assembly of claim 1, further comprising a housing configured to support the camshaft, the first cam roller, the second cam roller, the first pumping assembly, and the second pumping assembly.

12. The fuel pump assembly of claim 1, wherein the camshaft is eccentric such that a center of rotation of the cam lobe is offset relative to an axis of rotation of the camshaft.

13. The fuel pump assembly of claim 1, wherein at least one of the first pumping assembly and the second pumping assembly is a unit barrel pumping assembly.

14. A fuel pump assembly for an engine, comprising:

a fuel pump comprising:

a camshaft having a cam lobe, the camshaft configured to rotate;

a first cam roller and a second cam roller disposed about an outer surface of the cam lobe;

a first pumping assembly configured to interact with the first cam roller;

a second pumping assembly configured to interact with the second cam roller, wherein the second pumping assembly is offset from the first pumping assembly; and a third pumping assembly and a third cam roller, the third pumping assembly configured to interact with the third cam roller.

15. An engine system, comprising:

an engine block;

a cylinder head coupled to the engine block; and a fuel system comprising:

a plurality of fuel injectors positioned within the cylinder head; and a fuel pump comprising:

a camshaft having a cam lobe, the camshaft configured to rotate;

a first cam roller and a second cam roller disposed about an outer surface of the cam lobe;

a bushing positioned between the cam lobe and at least one of the first cam roller and the second cam roller, the bushing facilitating movement of at least one of the first cam roller and the second cam roller relative to the cam lobe;

a first pumping assembly configured to interact with the first cam roller; and a second pumping assembly configured to interact with the second cam roller, wherein the second pumping assembly is offset from the first pumping assembly.

16. The engine system of claim 15, further comprising a housing configured to support the camshaft, the first cam roller, the second cam roller, the first pumping assembly, and the second pumping assembly, the first pumping assembly and the second pumping assembly positioned on opposing sides of a central cavity of the housing.

17. The engine system of claim 15, further comprising at least one of a first valve assembly configured to regulate flow of low-pressure fluid into and out of a first pumping chamber and a second valve assembly configured to regulate the flow of low-pressure fluid into and out of a second pumping chamber.

18. The engine system of claim 15, further comprising:

a crankshaft configured to drive the fuel pump to pull fuel from a fuel tank to move the fuel toward a fuel injector, the crankshaft operatively coupled to the camshaft via a drive mechanism; and an electric lift pump configured to pull the fuel from the fuel tank and supply the fuel to the fuel pump.

* * * * *